US005173038A

United States Patent [19]

Hopfensperger et al.

[11] Patent Number: 5,173,038

[45] Date of Patent: Dec. 22, 1992

[54] PERISTALTIC PUMP

[75] Inventors: Reinhold Hopfensperger, Dietelskirchen; Rudolf Tungl, Ergolding; Albert Rockermeier, Herrngiersdorf, all of Fed. Rep. of Germany

[73] Assignee: Standard Elektrik Lorenz Aktiengesellschaft, Stuttgart, Fed. Rep. of Germany

[21] Appl. No.: 655,149

[22] Filed: Feb. 14, 1991

[30] Foreign Application Priority Data

Feb. 23, 1990 [DE] Fed. Rep. of Germany ..... 4005725
Oct. 5, 1990 [DE] Fed. Rep. of Germany ..... 4031554

[51] Int. Cl.[5] ..... F04B 43/12
[52] U.S. Cl. ..... 417/476
[58] Field of Search ..... 417/474, 476, 477

[56] References Cited

U.S. PATENT DOCUMENTS

| | | | |
|---|---|---|---|
| 409,000 | 8/1889 | Allen | 417/476 |
| 2,551,605 | 5/1951 | James et al. | 417/476 X |
| 2,897,767 | 8/1959 | Cordis | 417/476 X |
| 2,899,905 | 8/1959 | Becher | 417/476 X |
| 2,975,719 | 3/1961 | Kaufman . | |
| 3,597,123 | 8/1971 | Lutz | 417/476 X |
| 4,271,988 | 6/1981 | Clausen . | |
| 4,547,136 | 10/1985 | Rothstein . | |
| 4,968,229 | 11/1990 | Neuder | 417/474 |

FOREIGN PATENT DOCUMENTS

| | | | |
|---|---|---|---|
| 0320963 | 6/1989 | European Pat. Off. . | |
| 1528964 | 6/1969 | Fed. Rep. of Germany . | |
| 2033344 | 6/1971 | Fed. Rep. of Germany . | |
| 3912310 | 11/1989 | Fed. Rep. of Germany . | |
| 2347106 | 11/1977 | France . | |
| 2383333 | 10/1978 | France . | |
| 461845 | 2/1951 | Italy | 417/476 |

OTHER PUBLICATIONS

Sales Literature, "Dosierpumpe Type 14" (Peristaltic Pump Type 14) for SBS-Feintechnik, Schonach, Germany, undated.

*Primary Examiner*—Leonard E. Smith
*Attorney, Agent, or Firm*—Spencer, Frank & Schneider

[57] ABSTRACT

A peristaltic pump, which includes a flexible tube arranged along a circular path and in which a compression member is driven by an electric motor via a gearing, is to be compact and easy to manufacture, so that it can be produced at such a low cost as to be also suitable for applications where it has previously been too expensive. To accomplish this, parts of the pump are combined with parts of the gearing.

13 Claims, 4 Drawing Sheets

PERISTALTIC PUMP

BACKGROUND OF THE INVENTION

The present invention relates to a peristaltic pump comprising a flexible tube arranged along a circular path and a compression member for progressively and recurrently compressing the flexible tube. The compression member being drivable by an electric motor via a speed-reducing device.

Such peristaltic pumps are known in the art (e.g., as shown in a brochure entitled "Dosierpumpe Type 14" (Peristaltic Pump Type 14) for a product of SBS-Feintechnik, 7745 Schonach, Germany).

This prior art peristaltic pump is of a very complex design since it consists of three separate units, namely the electric motor, multistep reduction gearing, and the pump.

SUMMARY OF THE INVENTION

The technical problem underlying the invention is to provide a peristaltic pump which is easy to manufacture and lower in cost.

According to a preferred embodiment of the invention, this technical problem is solved by integrating the compression member with the speed-reducing device.

The peristaltic pump according to the preferred embodiments invention is compact and easy to manufacture. Therefore, it can be made at a low cost, so that it is also suitable for those applications where it has so far been too expensive. Its delivery of fluid is more uniform than that of the prior art peristaltic pump, and the flexible tube is subjected to less mechanical stress.

Advantageous details of additional preferred embodiments of the invention are described below. The invention will become more apparent by reference to the following description of the preferred embodiments taken in conjunction with the accompanying drawings:

DESCRIPTION OF THE PREFERRED EMBODIMENTS

Figure 2:
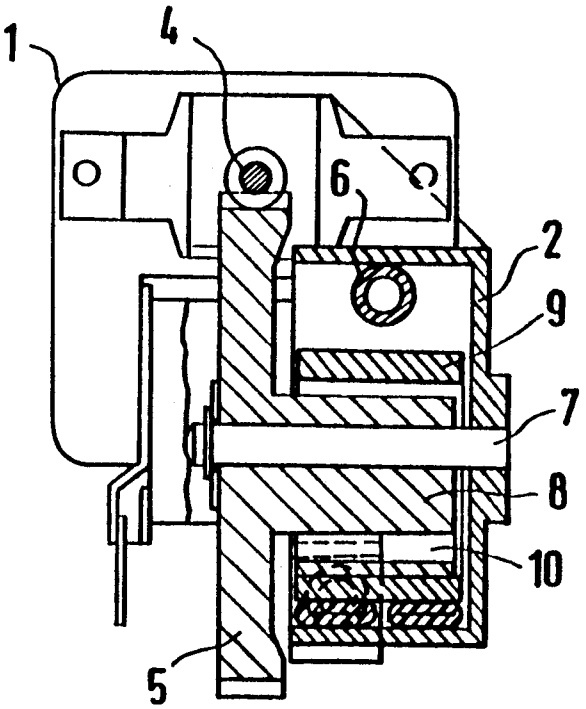
FIG. 2 is a section taken along line 2—2 of FIG. 1.
Figure 1:
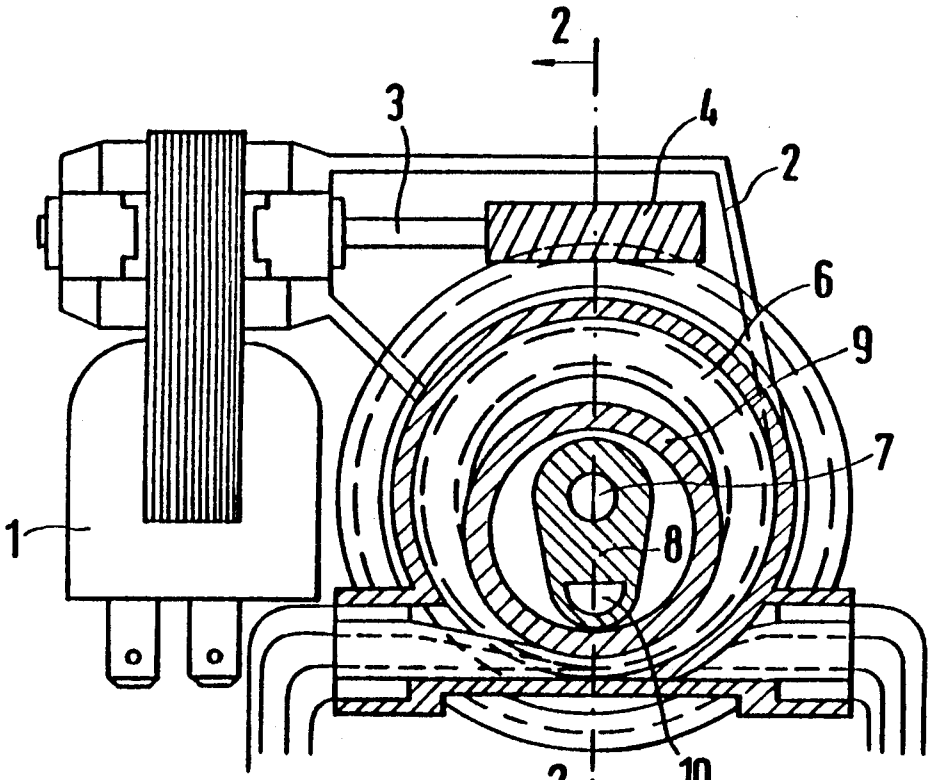
FIG. 1 is a side view of an embodiment of the peristaltic pump in accordance with the invention.

In the embodiment of a peristaltic pump shown in FIGS. 1 and 2, the compression member acts on the flexible tube in a radial direction and the flexible tube has an angle of contact greater than 360 degrees, so that in a given area the suction portion and the pressure portion of the flexible tube lie side by side.

In FIGS. 1 and 2, the electric motor 1 can be seen, which is connected with the casing 2. The output shaft 3 of the electric motor 1 is provided with the worm 4, which is either mounted as a separate part on or formed in the output shaft 3. The worm 4, preferably a single-start worm, meshes with the worm wheel 5. The worm wheel 5 may be replaced by a helical spur gear. The flexible tube 6 is arranged along the internal circumference of the casing 2. The worm wheel 5 is rotatably mounted on the shaft 7, which is fixed in, e.g., molded into, the housing 2, and integrally connected with the compression member. In the embodiment of FIGS. 1 and 2, the compression member consists of the asymmetrical cam 8 and the circular cylinder 9, which has a solid wall and loosely surrounds the cam 8. If the cam 8 is set rotating by the worm wheel 5, the circular cylinder 9 will roll over, and progressively compress, the flexible tube 6. The tip of the cam 8 contains a cavity 10. This cavity 10 results in a certain elasticity of the cam tip whereby manufacturing variations of the components are compensated for and hard loading of the flexible tube 6 is avoided. This results in a considerable prolongation of the service life of the flexible tube and, hence, of the peristaltic pump.

Figure 3:
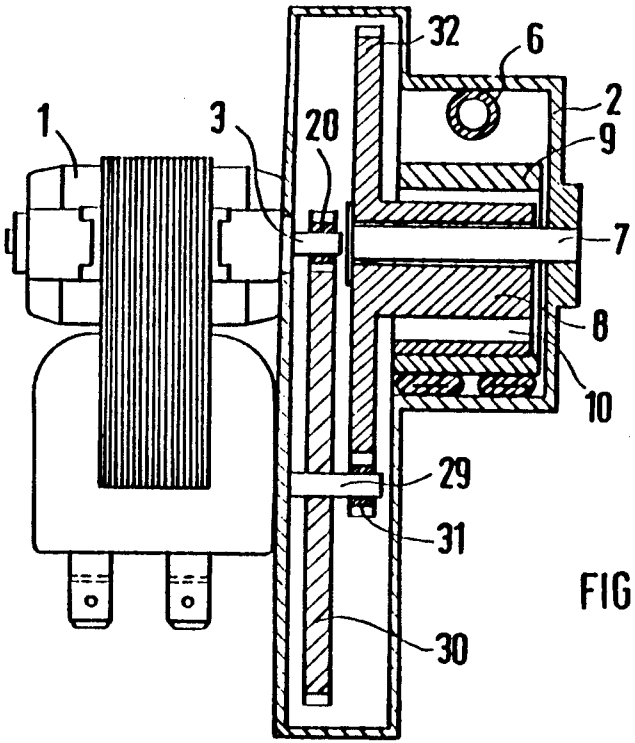
FIG. 3 shows a section through another embodiment of the peristaltic pump in accordance with the invention.

The second preferred embodiment of the peristaltic pump according to the invention shown in FIG. 3 differs from that of FIGS. 1 and 2 in that the speed-reducing device is a two-step spur gearing. In FIG. 3, the same reference numerals as in FIGS. 1 and 2 are used to designate corresponding parts of the peristaltic pump. The spur gearing consists of a pinion 28 mounted on the output shaft 3, a primary gear 30 and pinion 31 mounted on a shaft 29, and a secondary or final gear 32 which is integrally connected with the cam 8.

For the speed-reducing device, any conventional gearing can be employed.

FIGS. 4 to 8 show further preferred embodiments of the compression member.

Figure 4:
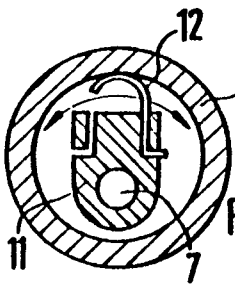

In the embodiment of FIG. 4, the compression member consists of a blocklike cam 11, a leaf spring 12, which is mounted at the end of the cam 11 remote from the shaft 1 and has the shape of the handle of a walking stick, and a circular cylinder 9 surrounding the compression member.

Figure 5:
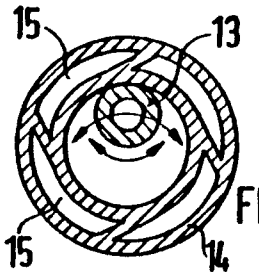

In the embodiment of FIG. 5, the compression member consists of a circular cylindrical cam 13, which is disposed on the worm wheel 5 asymmetrically with the shaft 7, (shown in FIGS. 1 and 2), and a circular cylinder 14, which loosely surrounds the cam 13 and is double-walled such that cavities 15 are present between the outer and inner walls. These cavities 15 have the same function as the cavity 10 of the embodiment of FIG. 1 and the leaf spring 12 of the embodiment of FIG. 3.

In the embodiment of FIG. 5, the cam 13 may be replaced by an axle stub having a bushing rotatably mounted thereon.

Figure 6:
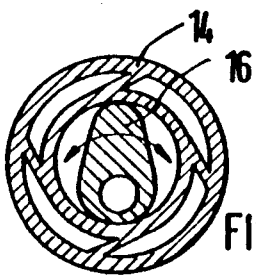

In the embodiment of FIG. 6, the compression member consists of a rigid cam 16 and a circular cylinder 14.

Figure 7:
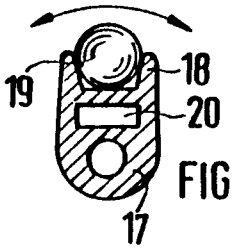

FIG. 7 shows a further embodiment of the compression member in which a cam 17 has a U-shaped end 18 in which a roller 19 is rotatably supported. Below the roller 19, a cavity 20 is provided. This embodiment of the compression member, too, may be surrounded by a circular cylinder 9. Instead of the cavity 20, a circular cylinder 14 may be provided.

Figure 8:
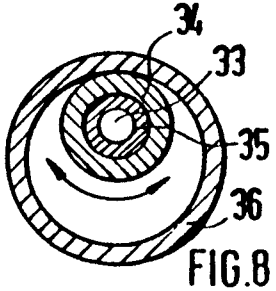
FIGS. 4 to 8 show different embodiments of the compression member of the peristaltic pump.

In the embodiment of the FIG. 8, the compression member includes the following parts: an eccentric pin 33 and a bushing 35 rotatably mounted thereon and provided with an elastic tire 34. The bushing 35 with the tire 34 may be loosely surrounded by the rigid cylinder 36.

Figure 11:
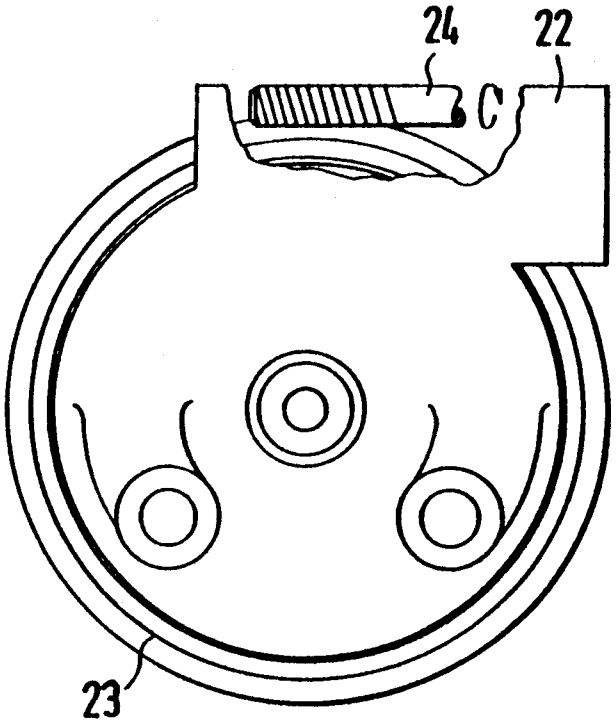
FIGS. 9 to 11 are different views of another embodiment of the peristaltic pump in accordance with the invention.
Figure 10:
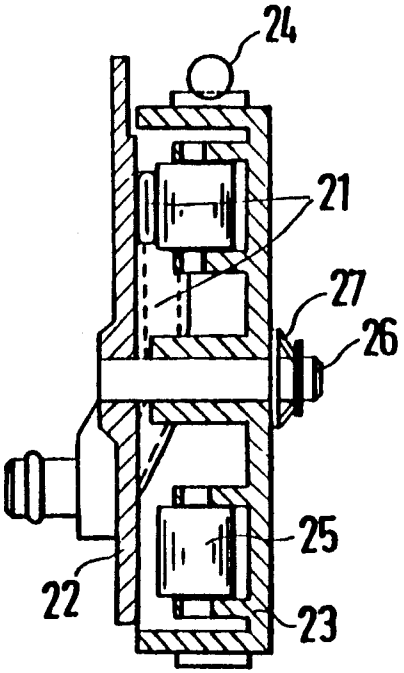
Figure 9:
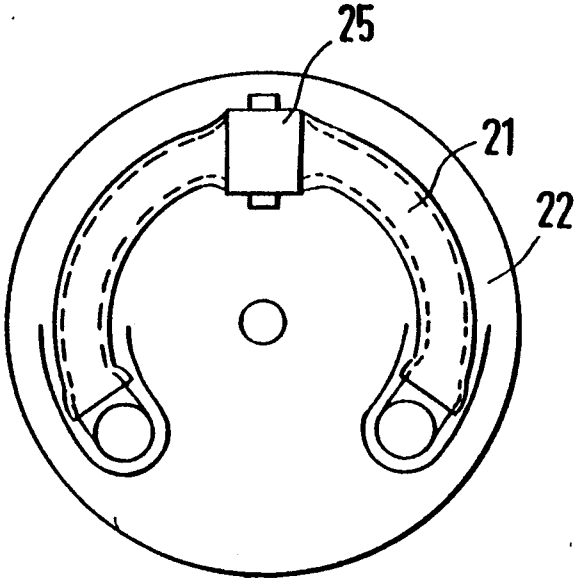

FIGS. 9 to 11 show an embodiment of the peristaltic pump according to the invention in which the compression members act on the flexible tube 21 in an axial direction. The construction of the peristaltic pump is apparent from the longitudinal section of FIG. 10. The pump comprises a casing 22 and a cup-shaped worm wheel 23, which can be driven by a worm 24. Within the worm wheel 23, rollers 25 are rotatably mounted in suitable supports. There is an axially yielding bearing 27 for worm wheel 23 which may be replaced by an axially resilient mounting of the roller 25 in the worm wheel 23. If, in the embodiments of FIGS. 9 to 11, the flexible tube 21 has an angle of contact greater than 360°, the worm wheel 23 may also be fitted with only one roller 25.

FIG. 9 is a front view of the casing 22 with the flexible tube 21 when the worm wheel 23 has been removed from the shaft 26. Only the roller 25 is shown.

FIG. 11 is a rear view of the peristaltic pump the embodiment of FIG. 9. The worm 24, in particular, can be seen after a portion of the casing 22 has been broken away.

The moving parts of the peristaltic pump in accordance with the invention may be made of both metal and plastic. If sliding friction between two parts is present, it depends on the material pair chosen whether additional lubrication is necessary.

Figure 13:
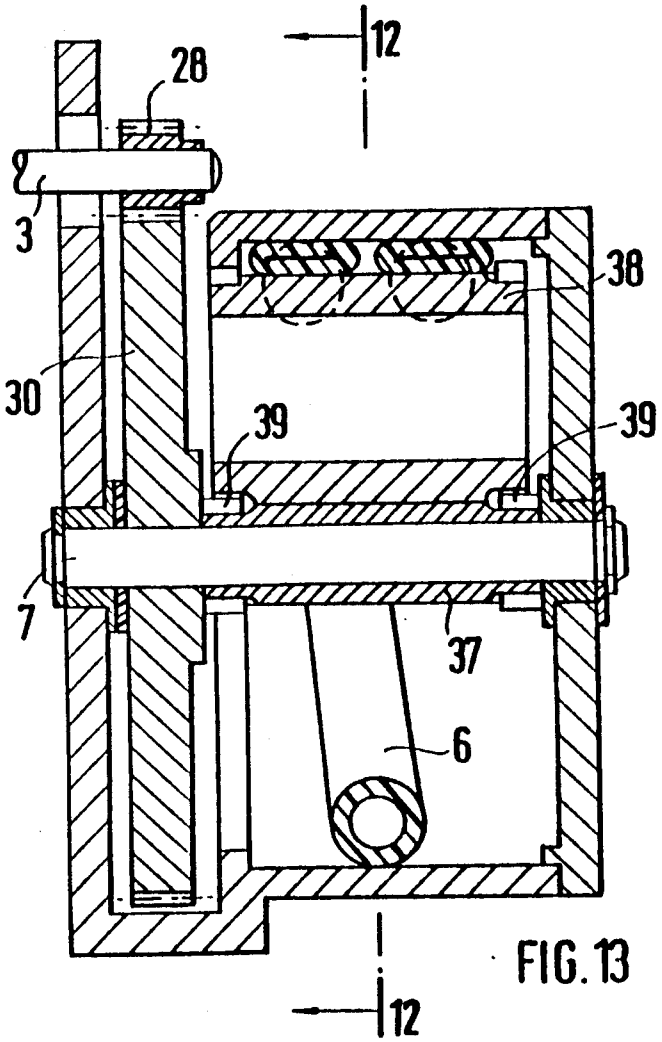
FIG. 13 is a section taken along line 13—13 of FIG. 12.
Figure 12:
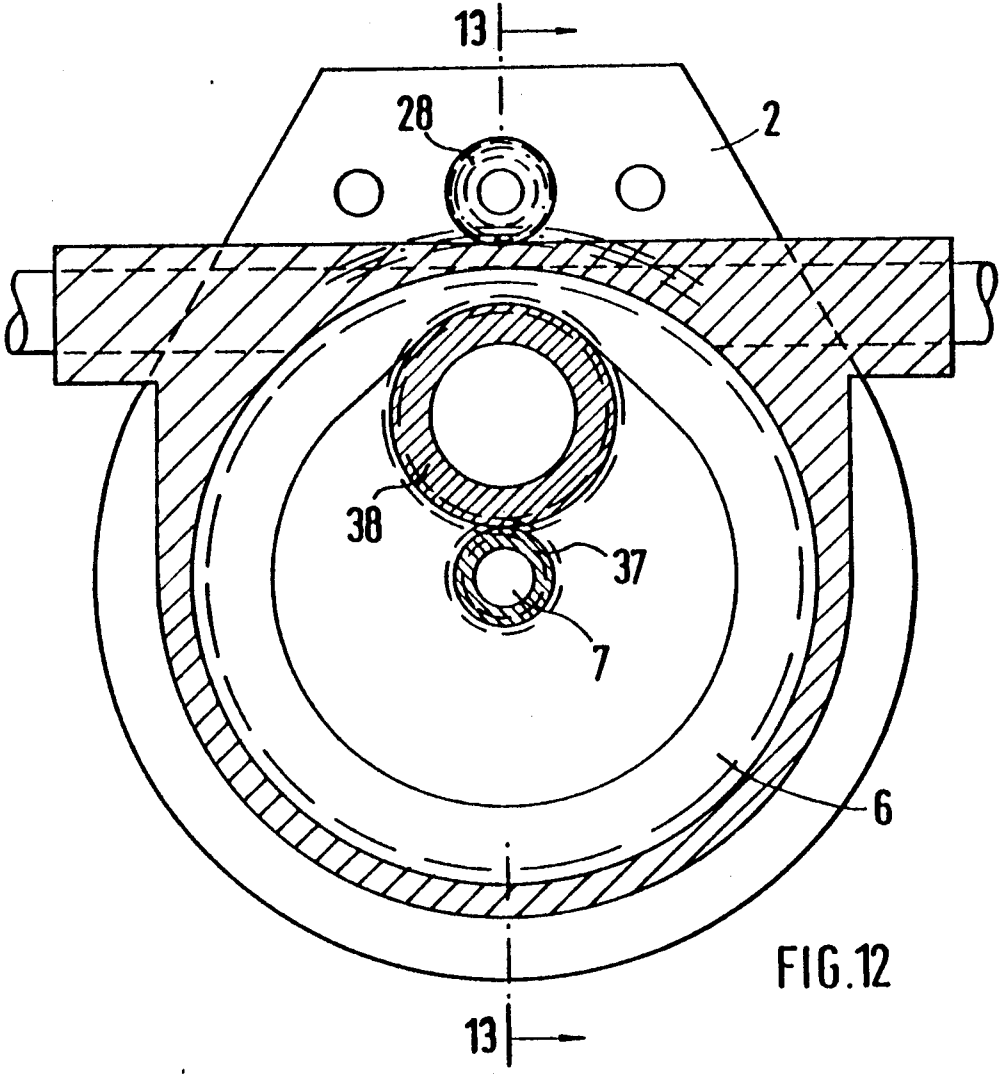
FIG. 12 is a longitudinal section of a further embodiment of the peristaltic pump in accordance with the invention, taken along line 12—12 of FIG. 13.

In FIGS. 12 and 13, the casing 2 can be seen, through the upper part of which extends the output shaft 3 with the pinion 28 mounted thereon. The pinion 28 meshes with the gear 30. Instead of the pinion 28 and the gear 30, a worm and a worm wheel could be used.

The gear 30 is integrally formed with a cylindrical extension 37, and both are rotatably mounted on the shaft 7. Between the extension 37 and the flexible tube 6, whose angle of contact is 360°, a hollow, cylindrical compression member 38 is provided. The extension 37 and the compression member 38 are arranged in the manner of a planetary gear train, with the extension 37 acting as a sun wheel, and the compression member 38 acting as a planet wheel. If such a peristaltic pump is to be used only for the delivery of liquids, nonpositive contact between the extension 37 and the compression member 38 will be sufficient. If the peristaltic pump is to be used as a controlled-volume pump, the extension 37 should be in at least partially positive contact with the compression member 38. In the embodiment positive contact is realized by providing both ends of the extension 37 and both ends of the compression member 38 with teeth 39. If the compression member 38 is made of an elastic material, this reduces the stress to which the flexible tube is subjected, and allows a simple compensation for manufacturing variations. The compression member 38 may be made wholly or in part of an elastic material; for example, compression member 38 may consist of a rigid tube and an elastic covering.

The illustrated embodiment of the peristaltic pump has only one compression member 38. It is also possible to provide two or more compression members 38, which are necessary if the angle of contact of the flexible tube is $\geqq 180°$.

The embodiment of the peristaltic pump shown in FIGS. 12 and 13 is especially suited for higher delivery rates, e.g., 120 ml/min, with a low torque requirement.

We claim:

1. A peristaltic pump comprising:

an electric motor;

a flexible tube arranged along a substantially circular path; and a rotatable compression member disposed adjacent to said flexible tube for progressively and recurrently compressing said flexible tube, said compression member including an integrally formed speed-reduction drive means coupled to said electric motor;

wherein said compression member comprises a block-like cam, a leaf spring disposed at an end of said cam, and a rigid substantially circular cylinder loosely surrounding said cam and said leaf spring.

2. A peristaltic pump as defined in claim 1, wherein said electric motor comprises a shaft having a worm defined thereon, and said drive means comprises a worm wheel engaging said worm.

3. A peristaltic pump as defined in claim 1, wherein said electric motor comprises a shaft having a primary spur gear disposed thereon, and said drive means comprises a final spur gear engaging said primary spur gear.

4. A peristaltic pump comprising:

an electric motor;

a flexible tube arranged along a substantially circular path; and a rotatable compression member disposed adjacent to said flexible tube for progressively and recurrently compressing said flexible tube, said compression member including an integrally formed speed-reduction drive means coupled to said electric motor;

wherein said compression member comprises an eccentric substantially circular cylindrical cam, and a pliable substantially circular cylinder having means defining cavities therein loosely surrounds said cam.

5. A peristaltic pump as defined in claim 4, wherein said electric motor comprises a shaft having a worm defined thereon, and said drive means comprises a worm wheel engaging said worm.

6. A peristaltic pump as defined in claim 4, wherein said electric motor comprises a shaft having a primary spur gear disposed thereon, and said drive means comprises a final spur gear engaging said primary spur gear.

7. A peristaltic pump comprising:

an electric motor;

a flexible tube arranged along a substantially circular path; and a rotatable compression member disposed adjacent to said flexible tube for progressively and recurrently compressing said flexible tube, said compression member including an integrally formed speed-reduction drive means coupled to said electric motor;

wherein said compression member comprises an asymmetrical, substantially circular cylindrical cam, and a pliable substantially circular cylinder having means defining cavities therein loosely surrounds said cam.

8. A peristaltic pump as defined in claim 7, wherein said electric motor comprises a shaft having a worm defined thereon, and said drive means comprises a worm wheel engaging said worm.

9. A peristaltic pump as defined in claim 7, wherein said electric motor comprises a shaft having a primary spur gear disposed thereon, and said drive means comprises a final spur gear engaging said primary spur gear.

10. A peristaltic pump comprising:

an electric motor;

a flexible tube arranged along a substantially circular path; and a rotatable compression member disposed adjacent to said flexible tube for progressively and recurrently compressing said flexible tube, said compression member including an integrally formed speed-reduction drive means coupled to said electric motor;

wherein said compression member comprises an eccentric pin having a bushing rotatably mounted thereon, and an elastic tire disposed between said bushing and said eccentric pin.

11. A peristaltic pump as defined in claim 10, wherein said electric motor comprises a shaft having a worm defined thereon, and said drive means comprises a worm wheel engaging said worm.

12. A peristaltic pump as defined in claim 10, wherein said electric motor comprises a shaft having a primary spur gear disposed thereon, and said drive means comprises a final spur gear engaging said primary spur gear.

13. A peristaltic pump as defined in claim 10, further comprising a rigid cylinder loosely surrounding said bushing.

* * * * *